United States Patent [19]

Francois

[11] 4,021,873

[45] May 10, 1977

[54] CIRCULAR WATERCRAFT

[76] Inventor: Joseph S. Francois, Rte. 2, New Richmond, Wis. 54017

[22] Filed: Nov. 3, 1975

[21] Appl. No.: 627,903

[52] U.S. Cl. ..... 9/2 A; 9/1.3; 114/123

[51] Int. Cl.[2] ..... B63B 7/08

[58] Field of Search ..... 9/1.1, 1.3, 2 A, 11 A, 9/340, 400; 114/.5 F, 123, 162, 165, 61, 66.5 F

[56] References Cited

UNITED STATES PATENTS

| | | | |
|---|---|---|---|
| 2,698,447 | 1/1955 | Potts et al. | 9/2 A |
| 2,752,616 | 7/1956 | Coates et al. | 9/11 A |
| 2,929,080 | 3/1960 | Daily | 9/2 A |
| 2,962,732 | 12/1960 | Marz | 114/123 |
| 2,991,746 | 7/1961 | Cunningham | 114/123 |
| 3,665,534 | 5/1972 | McIntyre | 9/2 A |
| 3,696,451 | 10/1972 | Thompson | 9/2 A |
| 3,812,805 | 5/1974 | Forssell et al. | 114/61 |

FOREIGN PATENTS OR APPLICATIONS

| | | | |
|---|---|---|---|
| 692,218 | 10/1930 | France | 114/162 |
| 828,024 | 2/1960 | United Kingdom | 9/11 A |

*Primary Examiner*—Trygve M. Blix
*Assistant Examiner*—Stuart M. Goldstein
*Attorney, Agent, or Firm*—Burd, Braddock & Bartz

[57] ABSTRACT

A circular watercraft has a buoyant, generally toroidal hull supporting a rigid deck with an outer periphery in substantial conformance with the perimeter of the hull. The deck has an opening located above the central opening of the hull to permit placement of power means to drive and steer the watercraft. The hull can be an inflated structure such as an inner tube. A stabilizer assembly connected to the hull and deck lends horizontal and vertical stability to the craft. Reserve floatation can be provided by an auxiliary torodial pontoon nested within the central opening of the hull but normally located above the water line.

15 Claims, 5 Drawing Figures

FIG. 3
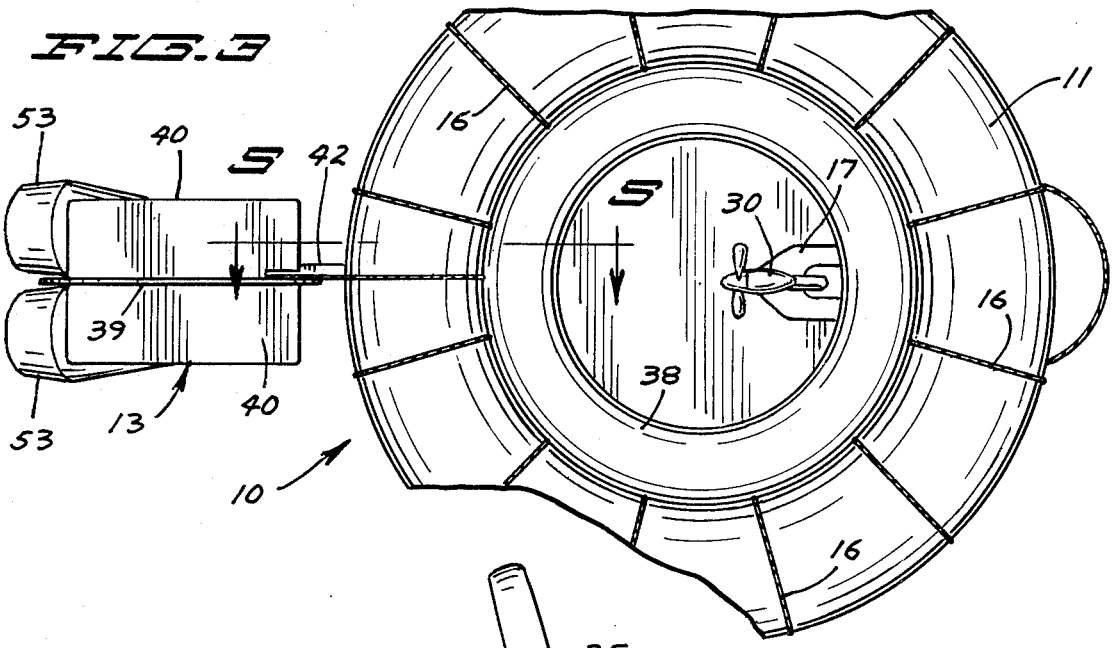
FIG. 4
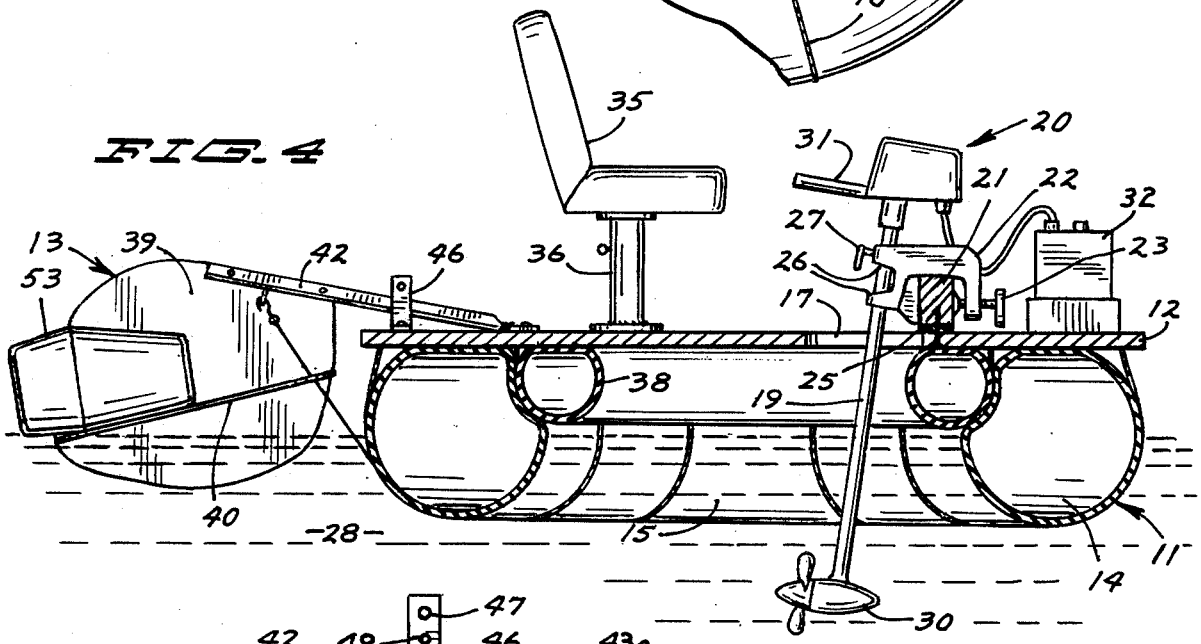
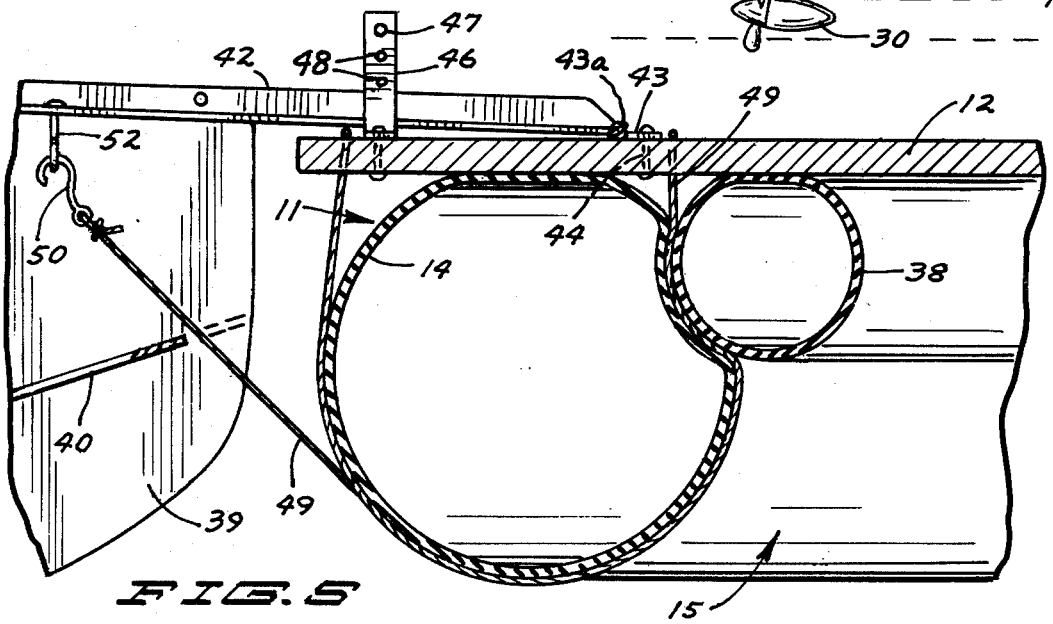
FIG. 5

CIRCULAR WATERCRAFT

BACKGROUND OF INVENTION

Inflatable watercraft are popular because they are readily transportable, light weight and usually economical. Such craft are typically paddled for propulsion but sometimes can be equipped with a motor. In general, such inflatable watercraft lack the stability characteristics of a more rigid craft. They usually do not provide a rigid deck surface for boarding, standing and the like.

Pontoon type watercraft are also popular and in general use because of the expansive, flat deck provided and the inherent stability of the craft. These boats typically have a pair of parallel, elongate spaced-apart pontoons which are usually not very portable. These watercraft are usually powered by an outboard motor.

A third type of watercraft meeting with some measure of popularity is the circular type of watercraft which is characteristically highly maneuverable in the water. See for example, U.S. Pat. No. 3,718,111 issued Feb. 27, 1973, to Del Vecchio.

SUMMARY OF INVENTION

The present invention relates to a substantially circular watercraft having a buoyant, pontoon type hull supporting a rigid, relatively expansive platform or deck. The hull is toroidal in shape and generally circular in cross section, providing stability and high maneuverability. The deck is supported on top of the hull, having a perimeter substantially coextensive with the perimeter of the hull. An opening is provided in the deck at a location above the central opening of the hull to permit placement of power means to drive and steer the watercraft. The centralized location of the steering enhances the maneuverability characteristics of the watercraft. The hull can be inflated structure such as an inner tube and, as such, is lightweight, readily transportable upon deflation and economical. Nested within the inflated hull can be a smaller auxiliary toroidal pontoon such as a second inflated inner tube. The second pontoon is nested in the upper portions of the central opening of the hull so as to normally be out of the water but coming into buoyant engagement with the water when an unusually large amount of weight is supported on the deck or when the hull is partially or totally deflated.

The watercraft includes a stabilizer assembly connected to the hull and deck and can have horizontal and vertical stabilizers for directional stability of the watercraft in motion. The stabilizer assembly can be provided with floatation units for stabilizing the watercraft when at rest or when in motion.

IN THE DRAWINGS

FIG. 3 is a bottom plan view of the watercraft in FIG. 1;

FIG. 4 is a sectional view of the watercraft of FIG. 1 taken along the line 4—4 thereof;

FIG. 5 is an enlarged sectional view taken along the line 5—5 of the watercraft shown in FIG. 3.

DESCRIPTION OF A PREFERRED EMBODIMENT

Figure 1:
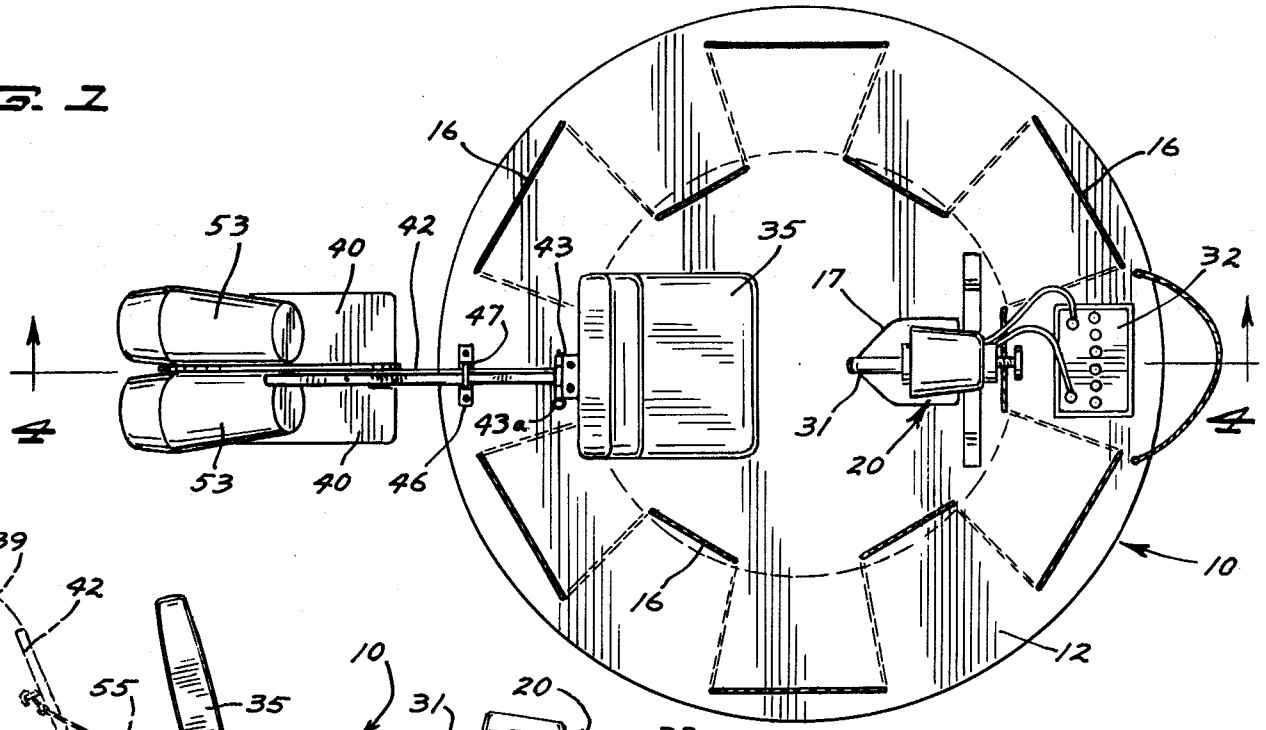
FIG. 1 is a top plan view of a watercraft according to the present invention.
Figure 2:
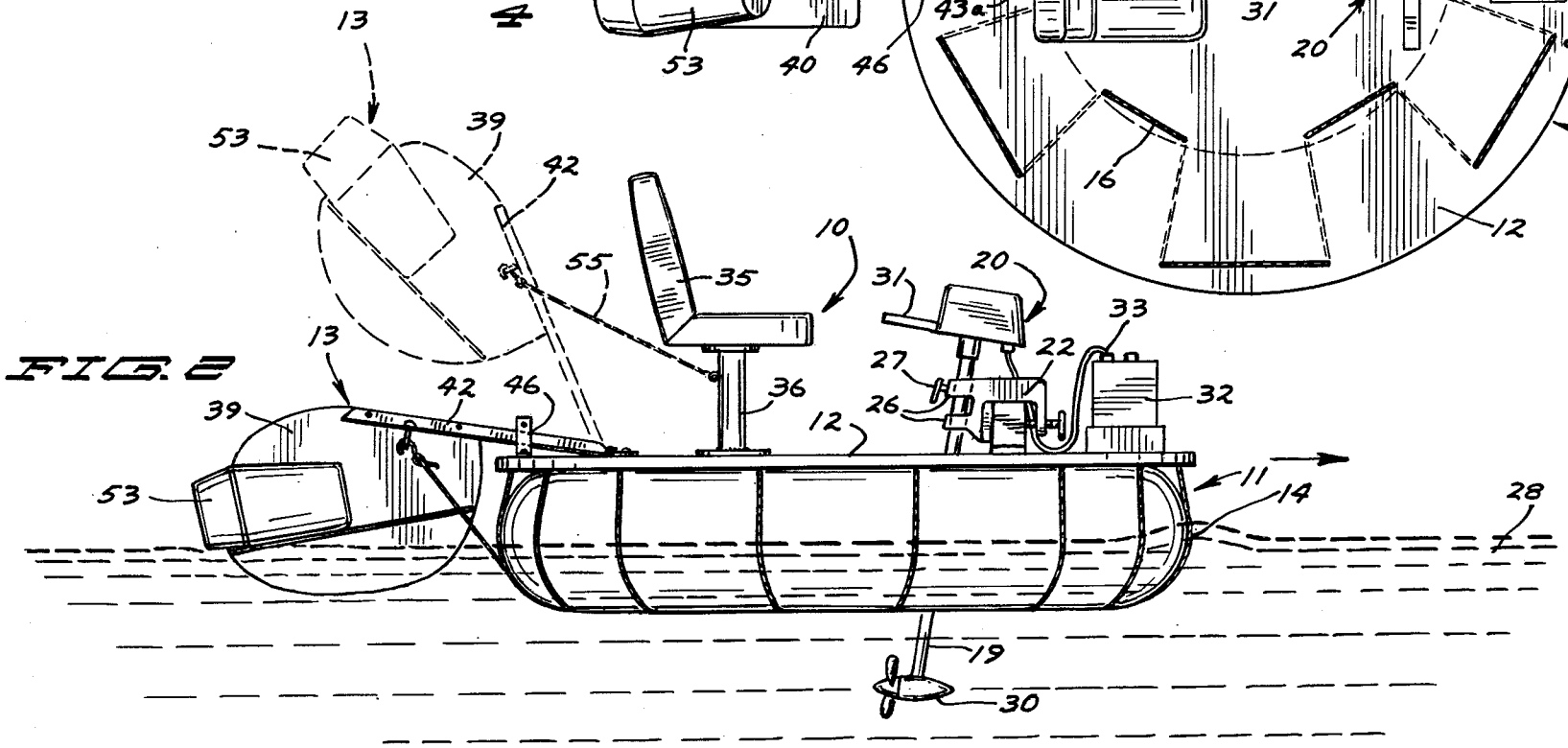
FIG. 2 is a side elevational view of the watercraft of FIG. 1 shown in motion in a body of water.

Referring to the drawings, there is shown in FIGS. 1, 2 and 4 a watercraft according to the present invention indicated generally at 10. Watercraft 10 has a buoyant hull 11 supporting a relatively rigid platform or deck 12 both of which are stabilized by a trailing stabilizer assembly 13. Watercraft 10 is highly maneuverable in the water, stable and buoyant while providing a relatively spacious deck for accommodation of passengers, fishing equipment or the like.

Hull 11 includes a generally toroidal pontoon 14 having a central opening 15 and a substantially circular cross section. As shown hull 11 has a flexible side wall and is inflated with air. Hull 11 can conveniently and economically be constituted as a large inner tube of the type readily available and commonly in use on large tractors. The flexible side wall is resilient and serves as a bumper for watercraft 10. The pontoon 14 of hull 11 could also be filled wth a floatation material such as an expanded plastic foam.

As shown in FIG. 1, deck 12 is circular having an outer perimeter substantially in conformance with the outer perimeter of hull 11. Deck 12 is fastened to the top of hull 11 by suitable means shown to include a cord 16 lacing deck 12 to the hull 11. Cord 16 alternately has segments extending over the top of the outer perimeter of deck 12, through deck 12 and under hull 11, back through deck 12 and across an inner portion of the top of the deck, and again through the deck and under the hull, repeated continuously around deck 12. Deck 12 is thus resiliently but securely fastened to the hull 11. Upon any relative impact between the deck and the hull, the flexible side wall of hull 11 yields against cord 16. Cord 16 can be rope, cable, nylon or the like. Other suitable means can be employed to secure deck 12 to hull 11.

Deck 12 has an opening 17 located above the central opening 15 of hull 11 for accommodation of the shaft 19 of an outboard motor 20. A motor mount 21 is secured to deck 12 forward of opening 17. A motor clamp 22 has a C-shaped jaw which engages motor mount 21 and is tightened in conventional fashion by threaded clamp member 23. A resilient cushion 25 is located between motor mount 21 and the deck 12. Cushion 25 provides shock absorbancy should the lower portion of motor 20 strike a submerged object. Clamp 22 has arcuate arms 26 which engage the shaft 19 of motor 20 and properly locate motor 20 relative to opening 17. A set screw 27 releasably secures shaft 19 in the clamp arms 26.

Shaft 19 of motor 20 extends through the opening 17 in the deck 12, and through the central opening 15 of hull 11 into a body of water 28. Shaft 19 terminates in propeller unit 30 for propulsion of watercraft 10. Propeller unit 30 is rotatable about a substantially vertical axis by manipulation of motor handle 31 in conventional fashion for steering of watercraft 10. Motor 20 can be of the electric type powered by an electric battery 32 connected to motor 20 through electric cables 33. An operator's seat 35 is mounted on a column 36 fastened to deck 12 in operative proximity to control handle 31 of motor 20. Seat 12 can be a single seat as shown, or it can be larger to accommodate more than one person.

As shown in FIGS. 3 to 5, watercraft 10 can be equipped with an auxiliary, toroidal pontoon 38 nested within the upper portion of central opening 15 of hull 11. The top of auxiliary pontoon 38 engages the lower surface of deck 12. Auxiliary pontoon 38 can be constituted as a second inner tube of the type used with truck tires, inflated with air and having an outer diameter just larger than the inside diameter of opening 15 of hull 11. Pontoon 38 is frictionally restrained in the upper portion of opening 11 in bearing relationship with the flexible side walls thereof. Pontoon 38 is positioned to be normally above the level of water body 28 when watercraft 10 carries a normal load. Under abnormal loading conditions tending to lower deck 12 toward the water, pontoon 38 comes into buoyant engagement with the water to offer auxiliary buoyancy as when deck 12 is heavily loaded or when hull 11 becomes partially or totally deflated. Auxiliary pontoon 38 alone offers sufficient buoyancy to support a sizeable load in an emergency as when hull 11 becomes fully deflated.

Stabilizer assembly 13 is effective to promote directional stability of watercraft 10 when in motion and to impart a measure of lateral stability to the watercraft when at rest. Stabilizer assembly 13 assembled to deck 12 is fixed in a horizontal plane but pivotal in a vertical plane. A pair of substantially horizontal stabilizers 40 are symmetrically secured to either side of a vertical stabilizer 39. A bar 42 is secured along the upper edge of vertical stabilizer 39 and extends generally horizontally to deck 12 where it is pivotally connected as by hinge 43 fastened to deck 12 by bolts 44 (FIG. 5). Hinge pin 43A of hinge 43 is removable so that stabilizer assembly 13 can be removed for transport (See FIG. 1). A bifurcated bracket 46 fixed to deck 12 has vertical arms which straddle bar 42. A removable pin 47 shown in FIGS. 1 and 5, spans the upper end of the arms of bracket 46 to limit the upward pivotal movement of bar 42 and thus stabilizer assembly 13. There are a plurality of vertically spaced holes 48 in the arms of bracket 46 for engagement by pin 47 to permit adjustment of the upper limit of pivotal movement of bar 42.

A yieldable hold-down assembly biases the stabilizer assembly 13 in a downward direction in stabilizing engagement with the water. Referring to FIG. 5, an elongate flexible cable or line 49 is fastened at one end to deck 12 above central opening 15 of pontoon 14. Line 49 extends from deck 12 downward through the central opening 15, around and in engagement with the side wall of pontoon 14. Line 49 extends through a suitable slot in a horizontal stabilizer 40, terminating in a hook 50 which releasably engages an eye 52 connected to the bar 42. Cable 49 normally holds stabilizer assembly 13 in a downward engagement with the water. Upon unusual force applied to the stabilizer assembly 13, as when striking an object in the water, force exerted on the cable 49 causes temporary yielding of the flexible side wall of pontoon 14 permitting upward movement of the stabilizer assembly 13. Such yieldable movement also occurs when the watercraft travels over waves or rough water.

In use, when in motion, vertical stabilizer 13 imparts directional stability to watercraft 10. Vertical stabilizer 39 counteracts the propensity of hull 11 to slip or skid over the water during execution of a turn. Horizontal stabilizers 40 horizontally stabilize or trim watercraft 10 to counteract the propensity of the front end of the watercraft to raise in the water during forward movement. The cable 49 holds the vertical stabilizers 39 and the horizontal stabilizers 40 in engagement with the water. The stabilizer assembly 13 is yieldable upon striking an object or a wave in the water. Damage to stabilizer assembly 13 is thus avoided.

A pair of buoyant members or outrigger-type floats are attached to horizontal stabilizers 40 and function primarily to impart a measure of static stability to watercraft 10 when at rest. When the watercraft is at rest, the operator may have occasion to move about deck 12 towards the edge thereof, as when fishing. When approaching the very edge of the deck 12, watercraft 10 normally would have a propensity to lean. As the rear of deck 12 is approached, the propensity to lean is counteracted by the buoyancy of the floats 53. As the rear edge of the deck 12 is tipped towards the water, floats 53 are pushed downward into the water and exert additional upward buoyant force tending to lift stabilizer assembly 13 and the rear edge of deck 12. Floats 53 can be closed tanks or expanded plastic foam members or the like. Floats 53 can be made larger or smaller depending on the size of watercraft 10 and the loading on the watercraft.

Stabilizer assembly is rotatable to an out-of-the-way position as shown in FIG. 2. By removal of the pin 47 from bracket 46, and release from hook 50 from eye 52, stabilizer assembly is pivotal upward as shown in phantom in FIG. 2. A line 55 can be located between the eye 52 on bar 42 and the column 36 of seat 35 to retain stabilizer assembly in the out-of-the-way position as shown. Removal of hinge pin 43A from the hinge 43 permits complete removal of stabilizer assembly 13.

While there has been shown and described a preferred embodiment of the watercraft according to the present invention, it will be apparent to those skilled in the art that deviations and alterations can be had from the embodiment shown without departing from the scope and spirit of the invention.

The embodiments of the invention in which an exclusive property or privilege is claimed are described as follows:

1. A watercraft including:

a hull comprising a first buoyant toroidal pontoon having flexible side walls and a central opening open to the water when the watercraft is situated in a body of water;

a rigid deck secured to the top of the first pontoon;

a second buoyant toroidal pontoon for auxiliary buoyancy having flexible side walls, a central opening, and a normal outside diameter slightly larger than the normal diameter of the central opening of the first pontoon, said second pontoon being frictionally nested within the central opening of the first pontoon adjacent to and beneath the deck in position normally out of the water when the watercraft is in a body of water and under normal loading conditions and coming into buoyant engagement with the water under abnormal loading conditions tending to lower the deck towards the water.

2. The watercraft of claim 1 wherein: the first pontoon is inflated with air.

3. The watercraft of claim 2 wherein: the second pontoon is inflated with air.

4. The watercraft of claim 1 including: an opening in said deck located over the central opening of the first pontoon and over the central opening of the second pontoon so to be open to the water when the watercraft is situated in a body of water, a motor mount on the deck located adjacent the opening in the deck for mounting of an outboard motor to drive the watercraft, an outboard motor mounted on the motor mount and having a shaft extended through the opening in the deck, and the openings of the first and second pontoons to the water, and seat means secured to the deck proximate the outboard motor for use by a watercraft operator.

5. The watercraft of claim 4 including: cushion means located on the motor mount to cushion an outboard motor.

6. The watercraft of claim 1 including: a stabilizer assembly fastened to the rear of said deck and engageable with the water to stabilize the hull when the hull is located in a body of water.

7. The watercraft of claim 6 wherein: said stabilizer assembly includes a vertical stabilizer and a pair of generally horizontal stabilizers, one of said horizontal stabilizers being located on each side of the vertical stabilizer.

8. A watercraft including:

a hull comprising a first buoyant toroidal pontoon having a central opening;

a deck secured to the top of the first pontoon;

a second pontoon for auxiliary buoyancy nested within the central opening of the first pontoon adjacent the deck in position normally out of the water when the watercraft is in a body of water and under normal loading conditions whereby under abnormal loading conditions tending to lower the deck towards the water, the second pontoon comes into buoyant engagement with the water;

a stabilizer assembly fastened to the rear of said deck and engageable with the water to stabilize the hull when the hull is located in a body of water, said stabilizer assembly including a vertical stabilizer and a pair of generally horizontal stabilizers, one of said horizontal stabilizers being located on each side of the vertical stabilizer;

said stabilizer assembly being pivotally assembled to said hull for pivotal movement in a vertical plane and including a pair of buoyant floats, one of said floats being secured on top of each of the horizontal stabilizers.

9. The watercraft of claim 8 wherein: said first pontoon has flexible side walls and is inflatable with air.

10. The watercraft of claim 9 including: a hold-down assembly to bias the stabilizer assembly in engagement with the water including an elongate flexible cable attached at one end to said deck approximate the central opening of the first pontoon, said cable extending under the first pontoon and having an opposite end fastened to the stabilizer assembly.

11. A watercraft including:

a buoyant pontoon type hull with flexible, inflatable side walls and a central opening open to the water when the watercraft is situated in a body of water;

a rigid horizontal deck secured to the top of the hull;

said deck having an opening located over the central opening of the hull so to be open to the water when the watercraft is situated in a body of water, a motor mount on the deck located adjacent the opening in the deck for mounting an outboard motor to drive the watercraft, an outboard motor mounted on the motor mount and having a shaft extended through the opening in the deck and the central opening in the hull to the water;

seat means secured to the deck proximate the outboard motor for use by a watercraft operator;

a stabilizer assembly pivotally assembled to the deck and engageable with water in trailing relationship to said hull when the hull is located in a body of water;

said stabilizer assembly including horizontal stabilizing means and vertical stabilizing means.

12. A watercraft including:

a buoyant pontoon type hull with flexible, inflatable side walls and a central opening;

a rigid horizontal deck secured to the top of the hull;

a stabilizer assembly pivotally assembled to the deck and engageable with water in trailing relationship to said hull when the hull is located in a body of water;

said stabilizer assembly including horizontal stabilizing means and vertical stabilizing means; and floatation units secured to the horizontal stabilizing means.

13. A watercraft including:

a buoyant pontoon type hull with flexible, inflatable side walls and a central opening;

a rigid horizontal deck secured to the top of the hull;

a stabilizer assembly pivotally assembled to the deck and engageable with water in trailing relationship to said hull when the hull is located in a body of water;

said stabilizer assembly including horizontal stabilizing means and vertical stabilizing means; and a hold-down assembly to bias the stabilizer assembly in engagement with water including an elongate flexible line secured to the deck proximate the central opening of the hull, extending under a portion of the hull, and attached at the opposite end to the stabilizer assembly.

14. The watercraft of claim 12 wherein: said hull includes a first toroidal pontoon, and including a second toroidal pontoon having flexible side walls located within the central opening of the first pontoon in frictional engagement with the side walls thereof in position normally out of the water when the watercraft is in a body of water and under normal loading conditions whereby under abnormal loading conditions tending to lower the deck towards the water, the second pontoon comes into buoyant engagement with the water.

15. A watercraft including:

a buoyant, pontoon type hull including a first toroidal pontoon with flexible, inflatable side walls and a central opening, a second toroidal pontoon having flexible side walls located within the central opening of the first pontoon in frictional engagement with the side walls thereof in position normally out of the water when the watercraft is in a body of water and under normal loading conditions whereby under abnormal loading conditions tending to lower the deck towards the water, the second pontoon comes into buoyant engagement with the water;

a rigid horizontal deck secured to the top of the hull;

a stabilizer assembly pivotally assembled to the deck and engageable with water in trailing relationship to said hull when the hull is located in a body of water;

said stabilizer assembly including a vertical stabilizer, a pair of generally horizontal stabilizers, one of said horizontal stabilizers being located on each side of the vertical stabilizer, a generally horizontal bar secured to the top of the vertical stabilizer at one end and pivotally assembled to the deck at the other end for pivotal movement in a vertical plane.

* * * * *